US006698142B2

(12) United States Patent
Denny

(10) Patent No.: US 6,698,142 B2
(45) Date of Patent: Mar. 2, 2004

(54) NETTING SYSTEM FOR USE WITH BLEACHERS AND GRANDSTANDS

(75) Inventor: David S. Denny, Middle Haddam, CT (US)

(73) Assignee: SINCO, Inc., Middletown, CT (US)

( * ) Notice: Subject to any disclaimer, the term of this patent is extended or adjusted under 35 U.S.C. 154(b) by 0 days.

(21) Appl. No.: 09/983,517

(22) Filed: Oct. 24, 2001

(65) Prior Publication Data

US 2002/0053171 A1 May 9, 2002

Related U.S. Application Data

(60) Provisional application No. 60/245,784, filed on Nov. 3, 2000.

(51) Int. Cl.[7] ..... E04H 3/12

(52) U.S. Cl. ..... 52/8; 52/6; 52/184; 182/138

(58) Field of Search ..... 52/6, 8, 173.1, 52/182, 184, 191; 182/138, 137

(56) References Cited

U.S. PATENT DOCUMENTS 4,982,813 A * 1/1991 Starr ..... 182/138
4,986,389 A * 1/1991 Halligan, Sr. et al. ..... 182/138
5,848,665 A * 12/1998 Rexroad et al. ..... 182/138
5,961,099 A * 10/1999 Thommen, Jr. ..... 256/12.5
6,098,750 A * 8/2000 Reynolds et al. ..... 182/138
6,161,648 A * 12/2000 Rexroad et al. ..... 182/138
6,182,790 B1 * 2/2001 Denny et al. ..... 182/138
6,305,310 B1 * 10/2001 Ferri ..... 114/343

* cited by examiner

*Primary Examiner*—Carl D. Friedman
*Assistant Examiner*—Jennifer I. Thissell
(74) *Attorney, Agent, or Firm*—IPLM Group, P.A.

(57) ABSTRACT

The present invention is a netting system (10) for use with bleachers and grandstands (11) to prevent children, persons, and debris from falling to the ground. A first end (12*a*) of a net (12) is operatively connected to a cable (18) proximate an attachment point (11*a*) proximate the top of the bleachers (11). Then, a second end (12*b*) of the net (12) is passed over the understructure (11*c*) of the bleachers (11) and then operatively connected to a cable (25) proximate an attachment point (11*b*) proximate the bottom of the bleachers (11).

13 Claims, 4 Drawing Sheets

NETTING SYSTEM FOR USE WITH BLEACHERS AND GRANDSTANDS

This application claims the benefit of U.S. Provisional Patent Application No. 60/245,784, filed Nov. 3, 2000.

BACKGROUND OF THE INVENTION

1. Field of the Invention

The present invention relates generally to a netting system for use with bleachers and grandstands.

2. Description of the Prior Art

There have been instances of children and persons falling through the benches of bleachers and grandstands, and these falls have resulted in serious bodily injury as well as fatalities. Therefore, there is a need for fall protection systems for use with bleachers and grandstands to prevent children and persons from falling to the ground. In addition, there is also a need for debris retention under bleachers and grandstands to not only aid in the ease of clean up but to prevent items from falling from the benches and injuring persons on the ground proximate the bleachers and grandstands.

SUMMARY OF THE INVENTION

A preferred embodiment netting system for use with bleachers operatively connected to a wall having a first attachment point includes a net having a first end and a second end, and the bleachers include at least one bench and a second attachment point. The first end of the net is operatively connected to the first attachment point of the wall, the second end of the net is operatively connected to the second attachment point of the bleachers, and the net is below the at least one bench.

In another preferred embodiment netting system for use with bleachers operatively connected to a wall having a first attachment point, a net has a first end, a middle portion, and a second end and the bleachers have at least one bench, an understructure, and a second attachment point. The first end of the net is operatively connected to the first attachment point. The middle portion of the net is passed over and supported by the understructure. The second end of the net is operatively connected to the second attachment point, and the net is below the at least one bench.

In another preferred embodiment netting system for use with bleachers operatively connected to a wall having a first attachment point, a net includes a first end, a middle portion, and a second end and the bleachers have at least one bench, an understructure, and a second attachment point. The first end of the net is operatively connected to the first attachment point, the middle portion of the net is passed over and supported by the understructure, and the second end of the net is operatively connected to the second attachment point. The net is below the at least one bench. A first cable is operatively connected to the first attachment point and the first end of the net is operatively connected to the first cable. A second cable is operatively connected to the second attachment point and the second end of the net is operatively connected to the second cable.

In another preferred embodiment netting system for use with bleachers, a net includes a first end, a middle portion, and a second end and the bleachers have a first attachment point, at least one bench, an understructure, and a second attachment point. The first end of the net is operatively connected to the first attachment point, the middle portion of the net is passed over and supported by the understructure, and the second end of the net is operatively connected to the second attachment point. The net is below the at least one bench. A first cable is operatively connected to the first attachment point and the first end of the net is operatively connected to the first cable. A second cable is operatively connected to the second attachment point and the second end of the net is operatively connected to the second cable.

In another preferred embodiment netting system for fall protection purposes used with bleachers operatively connected to a wall having a first attachment point, the bleachers have a width, an understructure, benches, and a second attachment point. The netting system includes a plurality of panels of netting field connected together to span the width of the bleachers having a first end, a middle portion, and a second end. A first cable is operatively connected to the first attachment point, and the first end of the panels of netting is operatively connected to the first cable. The middle portion is supported by the understructure of the bleachers below the benches. A second cable is operatively connected to the second attachment point, and the second end of the panels of netting is operatively connected to the second cable thereby providing fall protection below the benches of the bleachers.

A preferred embodiment safety netting and bleacher combination includes a net having a first end, a middle portion, and a second end. The bleachers have a first attachment point, at least one bench, an understructure, and a second attachment point. The first end of the net is operatively connected to the first attachment point, and the middle portion of the net is passed over and supported by the understructure. The second end of the net is operatively connected to the second attachment point, and the net is below the at least one bench.

A preferred embodiment method of providing fall protection for use with bleachers having a first attachment point, an understructure, and a second attachment point includes providing a net having a first end, a middle portion, and a second end. The first end is secured to the first attachment point, the second end is passed over the understructure of the bleachers whereby the middle portion of the net is supported by the understructure, and the second end is secured to the second attachment point.

Another preferred embodiment method of providing fall protection for use with bleachers operatively connected to a wall having a first attachment point, the bleachers having an understructure and a second attachment point, includes attaching a first cable to the first attachment point and attaching a second cable to the second attachment point. A net is provided having a first end, a middle portion, and a second end. The first end is secured to the first cable, the second end is passed over the understructure of the bleachers thereby supporting the middle portion of the net with the understructure, and the second end is secured to the second cable.

DETAILED DESCRIPTION OF THE PREFERRED EMBODIMENT

Figure 1:
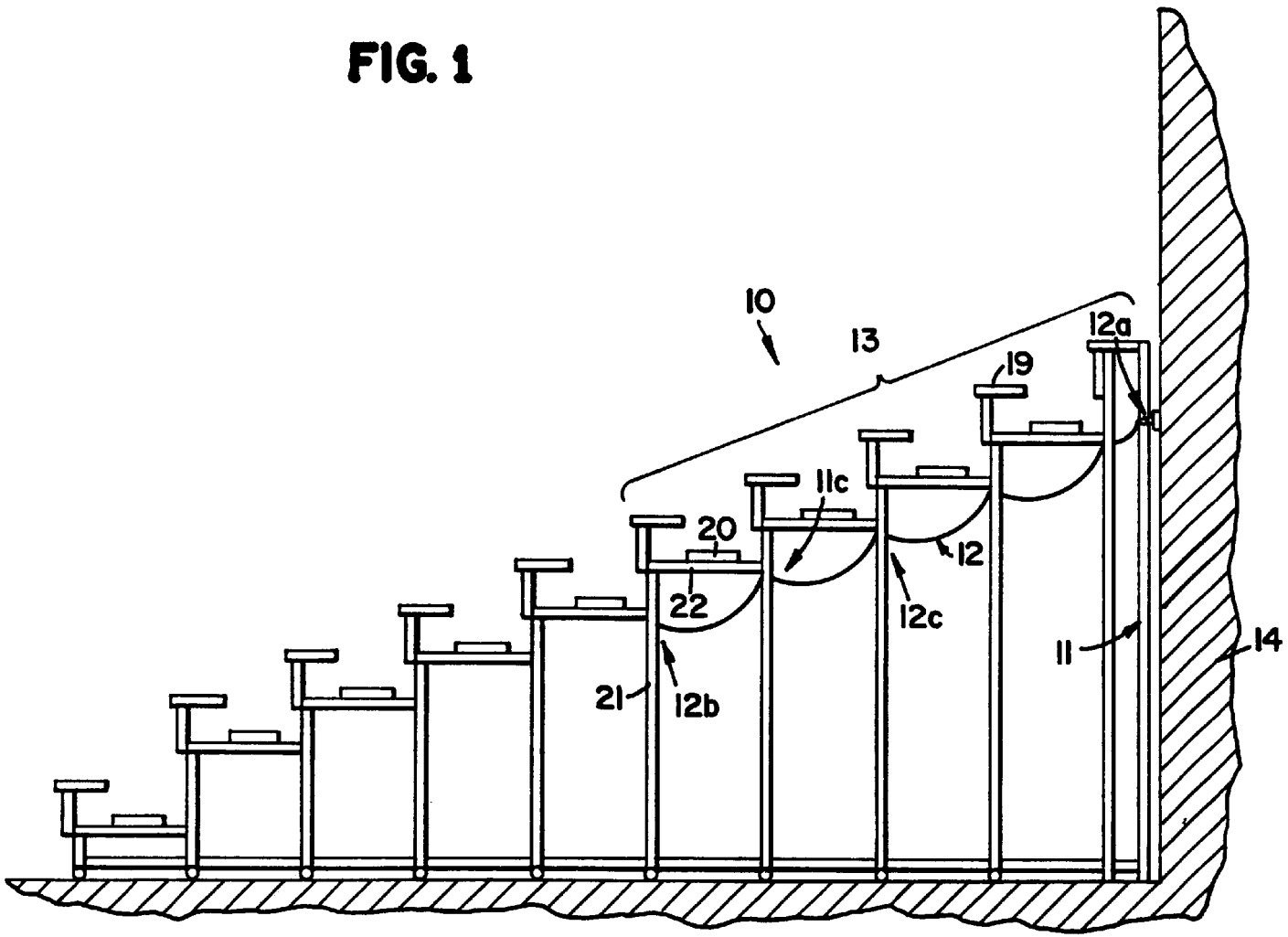
FIG. 1 is a side elevational view of a netting system operatively connected to a grandstand according to the principles of the present invention.

Referring to the drawings, wherein like reference numerals designate like parts and assemblies throughout the several views, a netting system for use with bleachers and grandstands constructed according to the principles of the present invention is designated as numeral 10 in FIG. 1.

Figure 3:
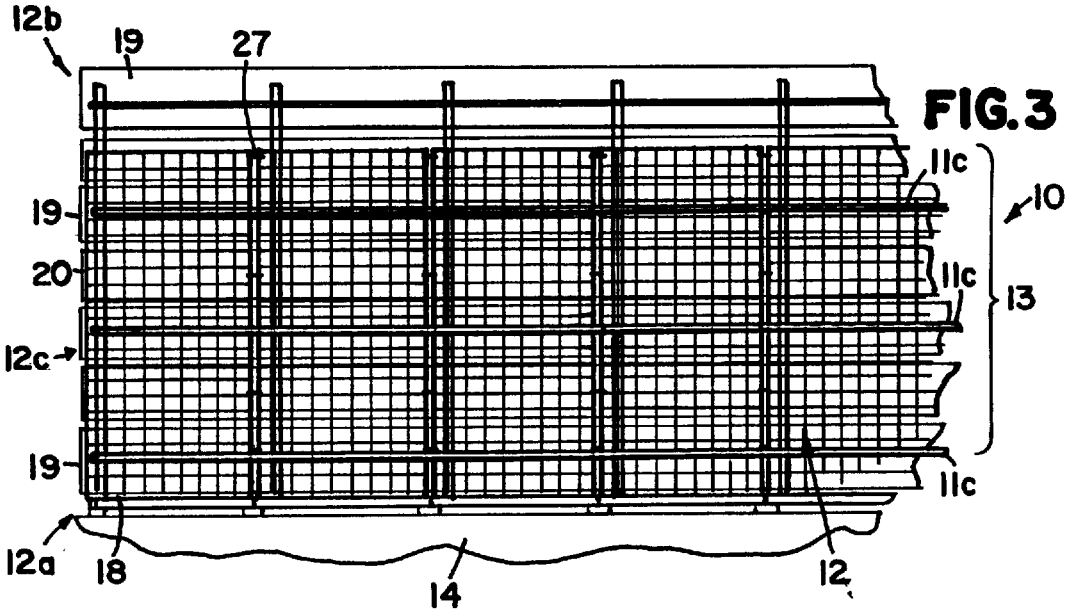
FIG. 3 is a bottom view showing a middle portion of the netting system shown in FIG. 1 operatively connected to the grandstand.

The netting system 10 for use with bleachers and grandstands includes netting 12, which is operatively connected to bleachers 11, as shown in FIG. 1. The netting 12 spans an area of protection 13 underneath the bleachers 11 to prevent children, persons, and debris from falling to the ground. In the preferred embodiment, netting 12 includes panels of netting approximately 9.0 feet long by 4.5 feet wide, which are field connected together at the site of installation by means well known in the art such as by clips 27, as shown in FIG. 3. The panels of netting are installed along the entire width of the bleachers 11 below the benches 19 in the area of protection 13, which is approximately 9.0 feet long in the preferred embodiment. Netting such as Model #145 manufactured by SINCO, Inc. or other suitable netting known in the art may be used. The netting should be strong enough to support children and persons. It is understood that longer and/or wider netting or multiple netting panels may be used to accommodate various sizes of bleachers and grandstands. Once the appropriate number of netting panels is installed according to the principles of the present invention, the adjacent sides of the netting panels are field connected together at the site of installation by means well known in the art such as by using snap hooks, connecting links, lashing, clips, and the like.

Figure 2:
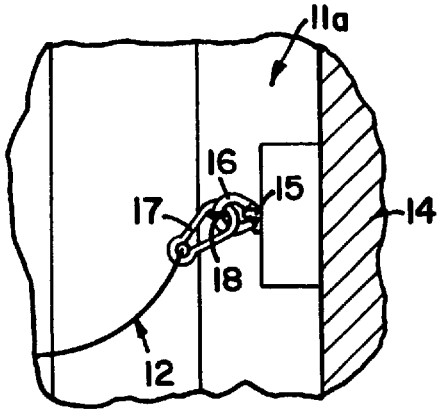
FIG. 2 is a side elevational view showing a first end of the netting system shown in FIG. 1 operatively connected to the grandstand.
Figure 5:
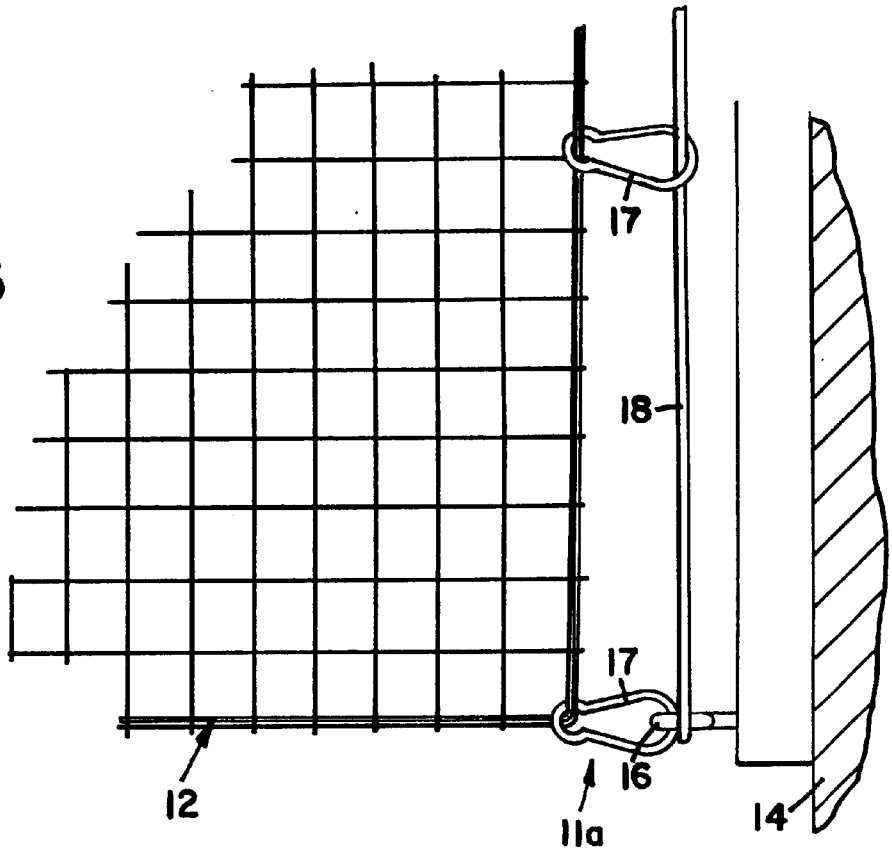
FIG. 5 is a top view of the first end of the netting system shown in FIG. 2.

Netting 12 includes a first end 12*a* and a second end 12*b*, and each end 12*a* and 12*b* includes at least two corners. Each corner of the first end 12*a* is attached to an eye nut 16, which is operatively connected to a threaded rod 15 existing in a wall 14 or other suitable structure proximate the back of the bleachers 11 thereby providing an attachment point 11*a*. As shown in FIGS. 2 and 5, each eye nut 16 is threaded onto the threaded rod 15, and a hook 17 connects each corner of the first end 12*a* of the netting 12 to each eye nut 16. A horizontal top cable 18 is also operatively connected between the eye nuts 16 proximate each of the top corners of the netting 12. In the preferred embodiment, the cable 18 is a continuous ¼ inch cable spanning the entire width of the bleachers underneath the top row of the benches. Along the cable 18, the netting 12 is connected to the cable 18 by a plurality of hooks 17. The hooks 17 are spaced along the cable 18 approximately one foot apart connecting the first end 12*a* to the cable 18. It is understood that other means for attaching the first end 12*a* of the netting 12 to the bleachers 11 may be used such as a series of eyebolts and hooks along the wall 14 or other means well known in the art.

Figure 4:
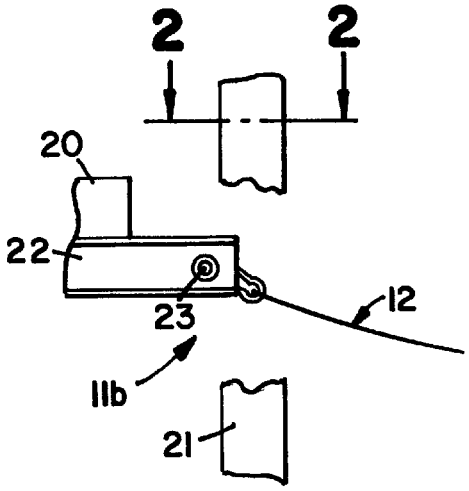
FIG. 4 is a side elevational view showing a second end of the netting system shown in FIG. 1 operatively connected to the grandstand.
Figure 6:
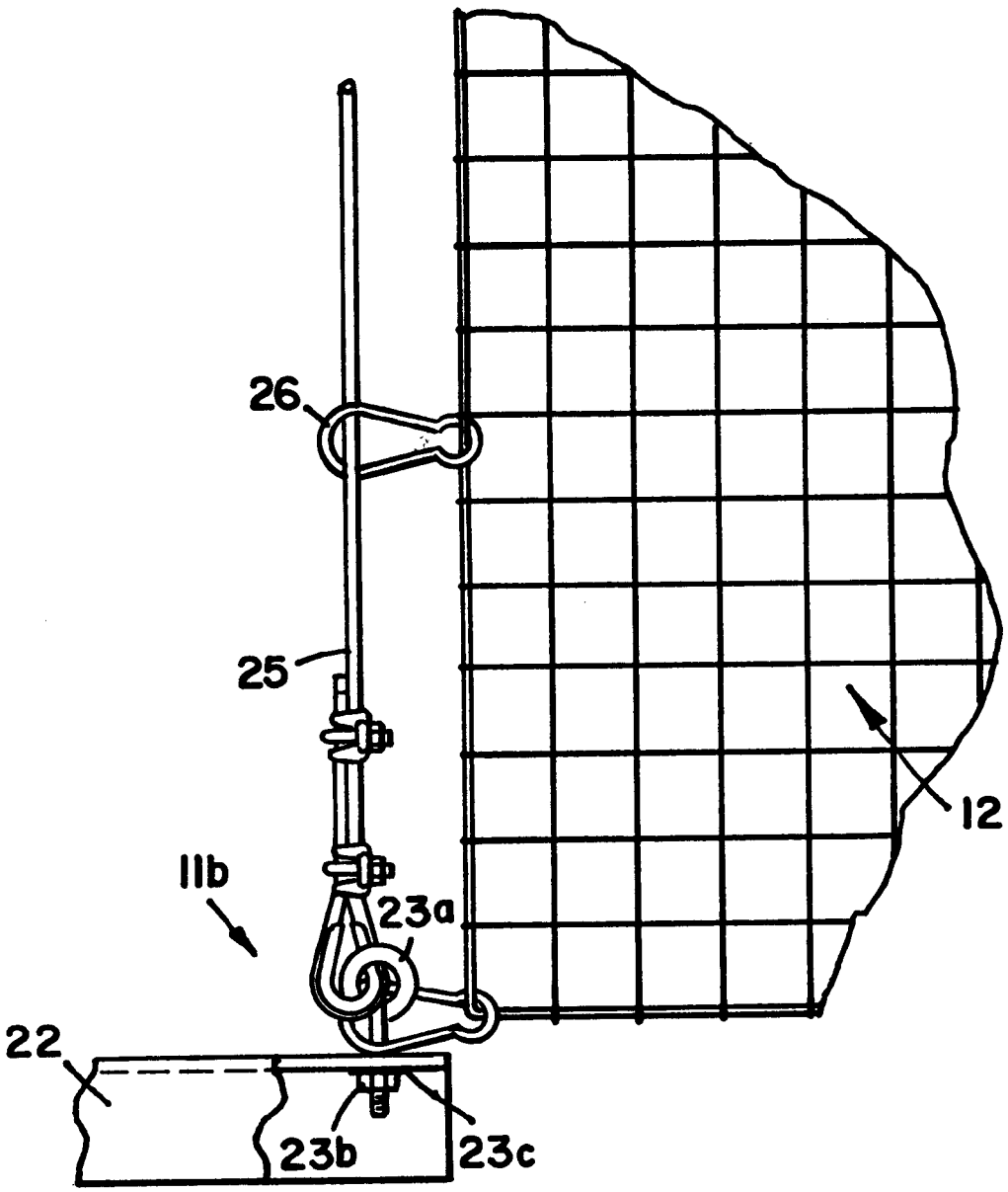
FIG. 6 is a top view of the second end of the netting system shown in FIG. 4.

In another embodiment, the top cable may be operatively connected to an attachment structure on the bleachers rather than on the wall proximate the top of the bleachers. This is accomplished in a similar manner as the bottom cable 25 is operatively connected to the attachment structure 11*b*, which is shown in FIGS. 4 and 6 and is described in more detail below.

Once the first end 12*a* is secured, the second end 12*b* is then passed over the steel understructure 11*c* of the bleachers 11 below the benches 19 and then connected to the horizontal bottom cable 25 by hooks 26. In the preferred embodiment, the steel understructure 11*c* is a plurality of elongate members extending below the benches 19, and the netting 12 is draped over the top of the elongate members. Thus, the middle portion 12*c* of the net 12 rests on and is supported by the understructure 11*c* below each bench 19 thereby providing a sectioned portion of netting below each bench 19 to ensure adequate fall protection in the area of protection 13, as shown in FIG. 3. Passing the netting 12 over the steel understructure 11*c* of the bleachers 11 ensures that the netting 12 will remain in position and simplifies installation by using the existing structure of the bleachers 11. Connecting the second end 12*b* to the horizontal bottom cable 25 is accomplished in a similar manner as the first end 12*a* is connected to the horizontal top cable 18 and is shown in FIGS. 4 and 6. The horizontal bottom cable 25 is operatively connected to an attachment structure 11*b*, which includes an attachment assembly 23 having an eyebolt 23*a*, a nut 23*b*, and a washer 23*c*, at each end of the bleachers 11 proximate the bottom of the bleachers 11. Along the cable 25, the second end 12*b* of the netting 12 is connected to the cable 25 by a plurality of hooks spaced along the cable 25 approximately one foot apart. It is understood that other means for attaching the second end 12*b* of the netting 12 to the bleachers 11 may be used such as a series of eyebolts and hooks along the understructure 11*c* of the bleachers 11 or other means well known in the art.

The bleachers 11 include vertical members 21 and horizontal members 22. In FIG. 4, the vertical member 21 is cut away for purposes of clarity. The attachment structure 11*b* is operatively connected to the horizontal members 22 of bleachers 11, as shown in FIGS. 4 and 6. Again, the attachment structure 11*b* includes an attachment assembly 23 having an eyebolt 23*a*, a nut 23*b*, and a washer 23*c*, but it is understood that other attachment means well known in the art may also be used. The eyebolts 23*a* provide an attachment point for the corners of the second end 12*b* of netting 12 and the horizontal bottom cable 25, as shown in FIG. 6. The horizontal bottom cable assembly includes cable 25, eyebolts, cable clamps, and other elements well known in the art. Again, the corners of the netting 12 are connected to the eyebolts by hooks 26, and hooks 26 are spaced along the cable 25 approximately one foot apart connecting the second end 12*b* to the cable 25. Again, the attachment structure 11*a* may be similar to the attachment structure 11*b* in that it is located on the bleachers rather than on the wall and the top and bottom cables may be operatively connected in a similar fashion to the respective attachment structures.

In operation, the bleacher netting system 10 protects children and persons from falling and injuring themselves, contains debris for ease of clean up, and contains debris to prevent injury to persons proximate the bleachers. Each sectioned portion of the netting 12 below each walking surface 20 ensures that the netting 12 will remain in position to maximize the fall protection provided between the vertical members 21. The bleacher netting system 10 is easy to install, and installation of the bleacher netting system 10 may occur on fixed bleachers as well as retractable bleachers commonly used in many school gymnasiums.

The above specification, examples and data provide a complete description of the manufacture and use of the composition of the invention. Since many embodiments of the invention can be made without departing from the spirit and scope of the invention, the invention resides in the claims hereinafter appended.

I claim:

1. A netting system, comprising:

a. bleachers operatively connected to a wall having a first attachment point, the bleachers having at least one bench, an understructure, and a second attachment point; and b. a net including a first end and a second end, said first end of said net being operatively connected to the first attachment point, said second end of said net being operatively connected to the second attachment point, wherein said net is below the at least one bench.

2. The netting system of claim 1, further comprising a middle portion of said net, said middle portion being passed over to understructure.

3. The netting system of claim 1, further comprising a first cable and a second cable, wherein said first cable is operatively connected to the first attachment point and said first end of said net is operatively connected to said first cable, and wherein said second cable is operatively connected to the second attachment point and said second end of said net is operatively connected to said second cable.

4. The netting system of claim 1, further comprising a plurality of panels of netting, wherein each of said panels is operatively connected to the panel located on either side of each of said panels to form the net.

5. A netting system, comprising:

a. bleachers operatively connected to a wall having a first attachment point, the bleachers having at least one bench, an understructure, and a second attachment point;

b. a net including a first end, a middle portion, and a second end, said first end of said net being operatively connected to the first attachment point, said middle portion of said net being passed over and supported by the understructure, and said second end of said net being operatively connected to the second attachment point, wherein said net is below the at least one bench; and c. a first cable and a second cable, wherein said first cable is operatively connected to the first attachment point and said first end of said net is operatively connected to said first cable, and wherein said second cable is operatively connected to the second attachment point and said second end of said net is operatively connected to said second cable.

6. The netting system of claim 5, further comprising a plurality of panels of netting, wherein each of said panels is operatively connected to the panel located on either side of each of said panels to form the net.

7. A netting system, comprising:

a. bleachers having a first attachment point, at least one bench, an understructure, and a second attachment point;

b. a net including a first end, a middle portion, and a second end, said first end of said net being operatively connected to the first attachment point, said middle portion of said net being passed over and supported by the understructure, and said second end of said net being operatively connected to the second attachment point, wherein said net is below the at least one bench; and c. a first cable and a second cable, wherein said first cable is operatively connected to the first attachment point and said first end of said net is operatively connected to said first cable, and wherein said second cable is operatively connected to the second attachment point and said second end of said net is operatively connected to said second cable.

8. A netting system for fall protection purposes, comprising:

a. bleachers operatively connected to a wall having a first attachment point, the bleachers having a width, an understructure, benches and a second attachment point;

b. a plurality of panels of netting field connected together to span the width of the bleachers having a first end, a middle portion, and a second end;

c. a first cable operatively connected to the first attachment point, said first end of said panels of netting being operatively connected to said first cable, said middle portion being supported by the understructure of the bleachers below the benches; and d. a second cable operatively connected to the second attachment point, said second end of said panels of netting being operatively connected to said second cable thereby providing fall protection below the benches of the bleachers.

9. A safety netting and bleacher combination, comprising:

a. a net having a first end, a middle portion, and a second end; and b. bleachers having a first attachment point, at least one bench, an understructure, and a second attachment point said first end of said net being operatively connected to the first attachment point, said middle portion of said net being passed over and supported by said understructure, and said second end of said net being operatively connected to said second attachment point, wherein said net is below said at least one bench.

10. A method of providing fall protection for use with bleachers having a first attachment point, an understructure, and a second attachment point comprising:

a. providing a net having a first end, a middle portion, and a second end;

b. securing said first end to the first attachment point;

c. passing said second end over the understructure of the bleachers whereby said middle portion of said net is supported by the understructure; and d. securing said second end to the second attachment point.

11. A method of providing fall protection for use with bleachers operatively connected to a wall having a first attachment point, the bleachers having an understructure and a second attachment point, comprising:

a. attaching a first cable to the first attachment point;

b. attaching a second cable to the second attachment point;

c. providing a net having a first end, a middle portion, and a second end;

d. securing said first end to the first cable;

e. passing said second end over the understructure of the bleachers thereby supporting said middle portion of said net with the understructure; and f. securing said second end to the second cable.

12. The safety netting and bleacher combination of claim 11, further comprising a first cable and a second cable, wherein said first cable is operatively connected to the first attachment point and said first end of said net is operatively connected to said first cable, and wherein said second cable is operatively connected to the second attachment point and said second end of said net is operatively connected to said second cable.

13. The safety netting and bleacher combination of claim 11, further comprising a plurality of panels of netting, wherein each of said panels is operatively connected to the panel located on either side of each of said panels to form the net.

* * * * *

UNITED STATES PATENT AND TRADEMARK OFFICE

CERTIFICATE OF CORRECTION

PATENT NO. : 6,698,142 B2
DATED : March 2, 2004
INVENTOR(S) : David S. Denny

It is certified that error appears in the above-identified patent and that said Letters Patent is hereby corrected as shown below:

Column 5,
Line 6, delete “to” and insert therefore -- the --

Column 6,
Line 20, insert -- , -- after “point”
Lines 53 and 61, delete “11” and insert therefore -- 9 --

Signed and Sealed this

Eighteenth Day of May, 2004

JON W. DUDAS
*Acting Director of the United States Patent and Trademark Office*